US007398721B1

(12) United States Patent
Alberding et al.

(10) Patent No.: US 7,398,721 B1
(45) Date of Patent: Jul. 15, 2008

(54) COLD-GAS MUNITIONS LAUNCH SYSTEM

(75) Inventors: Mark R. Alberding, Glen Arm, MD (US); Jorge I. Ciappi, Bel Air, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 205 days.

(21) Appl. No.: 11/091,221

(22) Filed: Mar. 28, 2005

(51) Int. Cl.
*F41F 3/052* (2006.01)
*F41F 3/077* (2006.01)

(52) U.S. Cl. ..... 89/1.818; 89/1.806; 89/1.819; 89/14.3

(58) Field of Classification Search ..... 89/1.819, 89/1.806, 8, 1.818, 14.3; 102/520, 522, 523
See application file for complete search history.

(56) References Cited

U.S. PATENT DOCUMENTS 2,382,152 A * 8/1945 Jakobsson ..... 102/523
3,088,377 A * 5/1963 Siegel ..... 89/1.81
3,476,048 A * 11/1969 Barr et al. ..... 102/399
3,815,469 A * 6/1974 Schubert et al. ..... 89/1.701
4,756,226 A * 7/1988 Piesik ..... 89/1.8
6,668,699 B2 * 12/2003 Russell ..... 89/14.05

FOREIGN PATENT DOCUMENTS

JP 2-296600 * 7/1990

OTHER PUBLICATIONS

Answers.com; Jul. 10, 2007; one page.*
English abstract of JP 2-296600; 2 pages.*

* cited by examiner

*Primary Examiner*—Stephen M Johnson
(74) *Attorney, Agent, or Firm*—DeMont & Breyer, LLC

(57) ABSTRACT

A cold-gas munitions launch system is disclosed. In the illustrative embodiment, the system includes a munitions canister, a gas generator, and a sled. The sled supports a munition. The gas generator is located in the aft end of the munitions canister. When ignited, the gas generator produces gas, which drives the sled forward. As the sled reaches the end of the canister, the munition is launched by its own inertia, at a velocity that is within the range of about 3 to 9 g. After the munition clears the canister and travels at least about 150 feet from it, the munition's booster is ignited.

8 Claims, 3 Drawing Sheets

100

COLD-GAS MUNITIONS LAUNCH SYSTEM

FIELD OF THE INVENTION

The invention relates to missile launchers, and more particularly to cold-gas missile launchers.

BACKGROUND OF THE INVENTION

A canisterized missile is typically launched using the missile's own booster—so called "hot launch." When the booster fires, a plume of high-temperature (i.e., in excess of 5000° F.), high-velocity exhaust gas is generated. Since the plume is quite erosive (e.g., due to its high velocity and sometimes the presence of metallic particulates, etc.), direct exposure to it adversely affects the missile, the missile canister, other launch structures, and the surrounding environs (e.g., deck of a ship, etc.).

As a consequence, most missile-launch systems include an exhaust-gas management system, which directs the booster plume away from the missile, launch structure, etc. But to survive the plume's extreme conditions, the launch structure, as well as the exhaust-gas management system itself, must incorporate thermal- and erosion-protection materials.

The exhaust-gas management system and thermal- and erosion-protection materials necessarily add weight, cost and complexity to the launching system. Furthermore, heating of the launch structure and deck that results from hot launch creates a residual thermal signature. This signature is readily detectable by various sensors, and therefore potentially compromises the survivability of the missile launcher and, indeed, the ship or vehicle that supports it.

To address the problems of hot launch, "cold launch" systems have been developed. In a cold launch, the missile's booster is not used to eject the missile from the missile canister; rather, some other means, which does not generate the high temperatures or the erosive flow of a missile plume, is used. After the missile clears the canister, the missile's booster fires, with minimal impact on the launch structure, etc.

Existing cold launch systems have a variety of drawbacks. One drawback is that most cold launch system include a substantial number of additional components. Another drawback is that in some cold launch systems, the missile is exposed to high-pressure gas from a gas generator (that provides the pressure for launch).

SUMMARY

The present invention is a cold-gas munitions launch system that avoids some of the costs and disadvantages of the prior art.

A cold-gas munitions launch system in accordance with the illustrative embodiment of the present invention includes a munitions canister, a gas generator, and a sled. The sled supports a munition.

The sled, which seals against the inside of the canister, is spaced a distance from the aft end of the canister. In the illustrative embodiment, the gas generator is located at the extreme aft end of the canister, partially within a hemispherical-shape closure. In some embodiments, there is small gap or plenum between the gas generator and the sled prior to launch.

When the gas generator ignites, it produces gas, which drives the sled forward. As the sled moves, a plenum is created (or enlarged in embodiments in which it is present at pre-launch). The plenum is defined by the hemispherical-shape closure at the aft end, the inside walls of the canister, and the hemispherical-shape bottom of the sled. The gas is retained within the plenum since the sled seals against the inside wall of the canister. The plenum expands as the sled advances with the canister.

The plenum continues to receive gas and expand by driving the sled forward. Near the end of it's travel, the sled passes vents in the canister. The vents open to release the gas contained within the plenum. As the sled reaches the end of the canister, the munition is launched by its own inertia, at a velocity that is within the range of about 3 to 9 g.

After the munition clears the canister, and more particularly at a distance of about 150 feet therefrom, the munition's booster is ignited. This substantially decreases the impact that the plume has on the launch system, deck, etc., thereby eliminating the need for an exhaust-gas management system.

BRIEF DESCRIPTION OF THE DRAWINGS

FIG. 1 depicts the system in a pre-launch state, before the plenum is pressurized.

DETAILED DESCRIPTION

Figure 1:
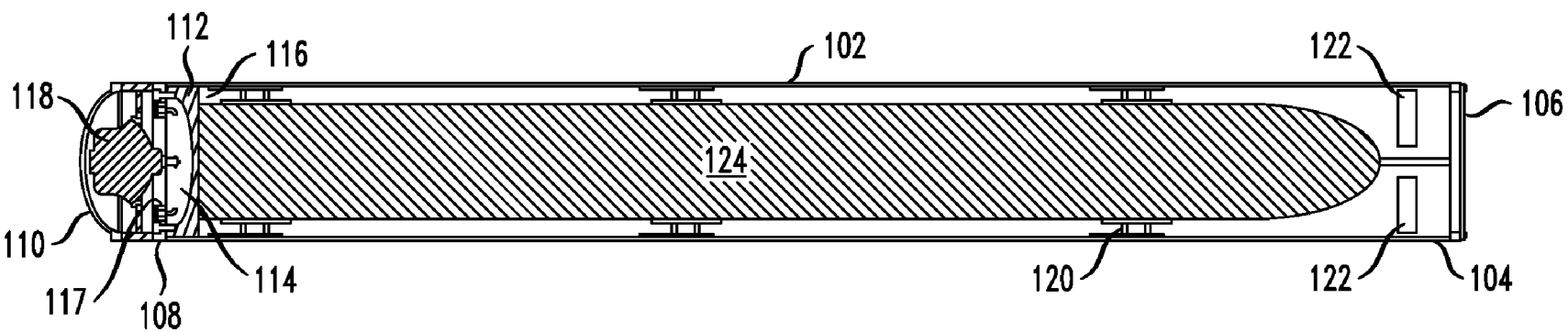
FIG. 1 depicts a side, cross-section of a cold-gas munitions launch system in accordance with the illustrative embodiment of the present invention.

FIG. 1 depicts cold-gas munitions launch system 100 in accordance with the illustrative embodiment of the present invention. System 100 is depicted in a pre-launch state in FIG. 1.

In the illustrative embodiment, system 100 includes canister 102, sled 112, and gas generator 118, arranged as shown. Canister 102 contains munition 124. As used in this specification, the term "munition(s)" means any canistered projectile that includes a booster, such as any of a variety of missiles, airborne tagging systems, etc.

In the Figures, canister 102 is depicted in a horizontal position. It is to be understood that, during an actual launch, canister 102 will be partially upright (i.e., inclined), but not fully vertical. A fully vertical launch position is avoided so that if the missile fails to fire after it's ejected from canister 102, it will not fall back onto system 100.

With continued reference to FIG. 1, forward end 104 of canister 102 is sealed by a closure, such as a fly-through cover, etc., well known in the art. In the illustrative embodiment, forward end 104 also includes vents 122. Until launch, the vents are closed to isolate the inside of canister 102 from the ambient of environment. The purpose for the vents is described later in this specification.

Prior to launch, sled 112 is coupled to aft end 108 of canister 102, such as by explosive bolts 117. The aft or rear-facing surface of sled 112 is shaped to maximize pressure load; in the illustrative embodiment, it has a hemispherical shape. The forward-facing surface of sled 112 is flat and supports munition 124. The munition is also supported, along its length, by a plurality of movable, collapsible rail "cars" 120 that move along the inner surface of canister 102. The munition is coupled to sled 112 by explosive bolts (not depicted) or some other means.

In preparation for launch, sled 112 must decouple from canister 102, and munition 124 must decouple from the sled, which is the purpose for the explosive bolts. In some alternative embodiments, combined active/passive restraint mechanisms can be used for reversibly securing sled 112 to canister 102 and munition 124 to sled 112, such as the mechanism disclosed in applicant's co-pending U.S. patent application Ser. No. 11/091,233. This case is incorporated by reference herein.

In the illustrative embodiment, gas generator 118 is disposed within canister 102, aft of sled 112. In the illustrative embodiment, gas generator 118 is disposed partially within aft hemispherical closure 110. The gas generator provides the driving force to launch munition 124. More particularly, gas generator 118 supplies gas at a rate and pressure that is sufficient to accelerate sled 112 and munition 124 to a launch velocity of between about 3 to about 9 g (i.e., about 96 to about 288 ft/s). The specific output requirement of the gas generator, in terms of pressure and flow rate, is a function of the weight of munition, which can vary widely as a function of munition type.

Figure 2:
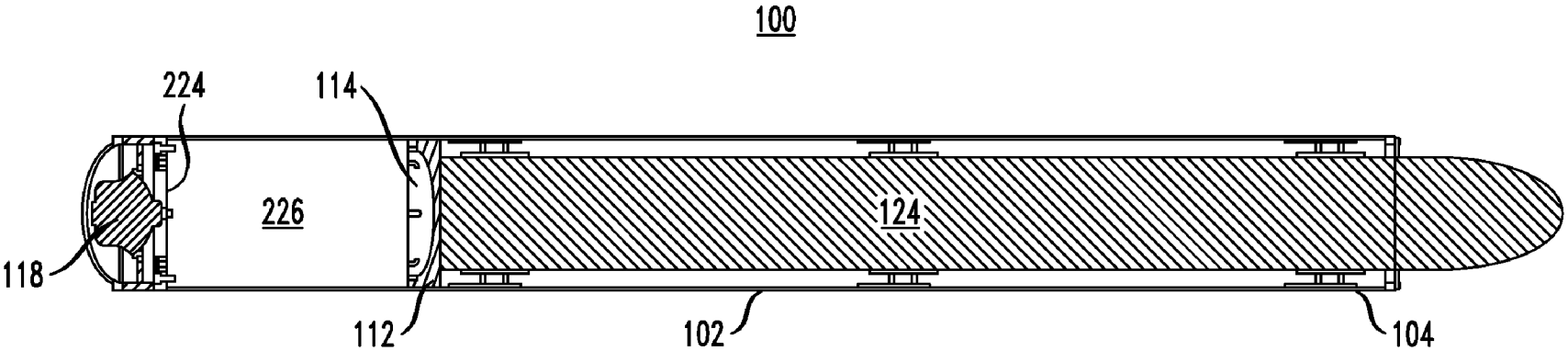
FIG. 2 depicts a side, cross-section of the cold-gas munitions launch system of FIG. 1, wherein the plenum is pressurizing, propelling the sled and munition through the canister.

FIG. 2 depicts munition 124 in the process of being launched from canister 102. It was previously disclosed that sled 112 is coupled to canister 102 and munition 124 is coupled to the sled. Before launch, sled 112 must be released. Munition 124 must also be released, although this can occur any time before sled 112 reaches the end of its travel at the forward end of canister 102 (see, e.g., U.S. patent application Ser. No. 11/091,233.

Plenum 226 is defined between seal 224 and bottom surface 114 of sled 112. Sled 112 is suitably sealed against the inner wall of canister 102, so that plenum 226 is capable of retaining gas that is delivered by gas generator 118. This enables pressure to build within the plenum, which drives sled 112 and munition 124 forward. It is notable that the plenum enlarges as sled 112 advances.

Often, munition 124 will have a larger diameter at its tail than its nose. As consequence, as sled 112 and munition 124 advance through canister 102, rail cars 120 collapse against the inner wall of the canister to facilitate passage of the munition.

Figure 3:
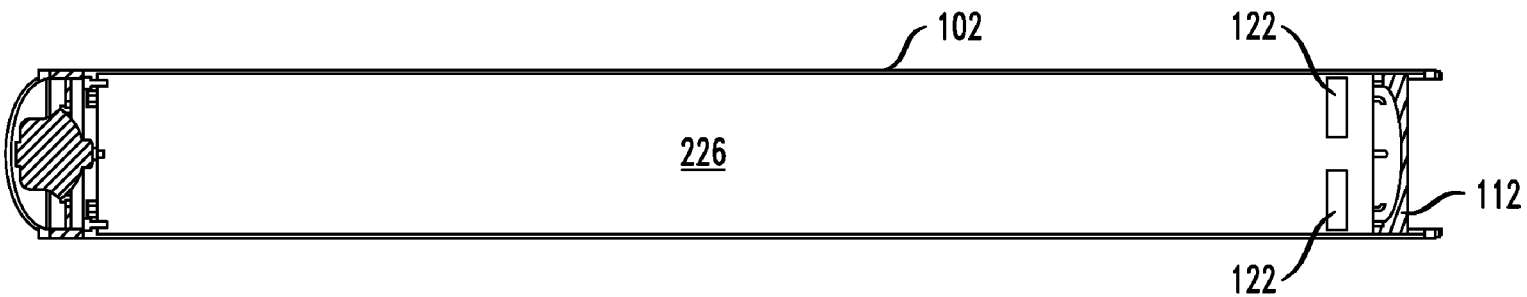
FIG. 3 depicts a side, cross-section of the cold-gas munitions launch system of FIG. 1, wherein the sled has reached the end of its travel and the missile is propelled from the canister by its own inertia.

FIG. 3 depicts system 100 after munition 124 has been launched from canister 102. Sled 112 is prevented from "launching" from canister 112 or falling downward within the canister by stops (not depicted) that are located at forward end 104. As sled 112 passes vents 122 at forward end 104 of canister 102, pressure is vented from plenum 226, which is now enlarged to occupy substantially the whole canister. The vents can be opened via either a passive mechanism or an active mechanism. For example, the vents can be pre-scored regions of the canister, such that once the sled passes, and the pre-scored regions are exposed to the gas pressure in plenum 226, they open. Alternatively, as sled 112 passes vents 122, a protrusion on the sled can engage vents 122, causing the vents to open. As to an active mechanism, a shape charge can be attached to pre-scored regions of the canister. Once sled 112 passes the pre-scored regions, the charge is triggered.

In the illustrative embodiment, cold-gas munitions launch system 100 includes an internally-located gas generator (i.e., gas generator 118). In some alternative embodiments, gas is sourced externally and delivered to aft end 108 via appropriate tubing, etc., (not depicted).

Figure 4:
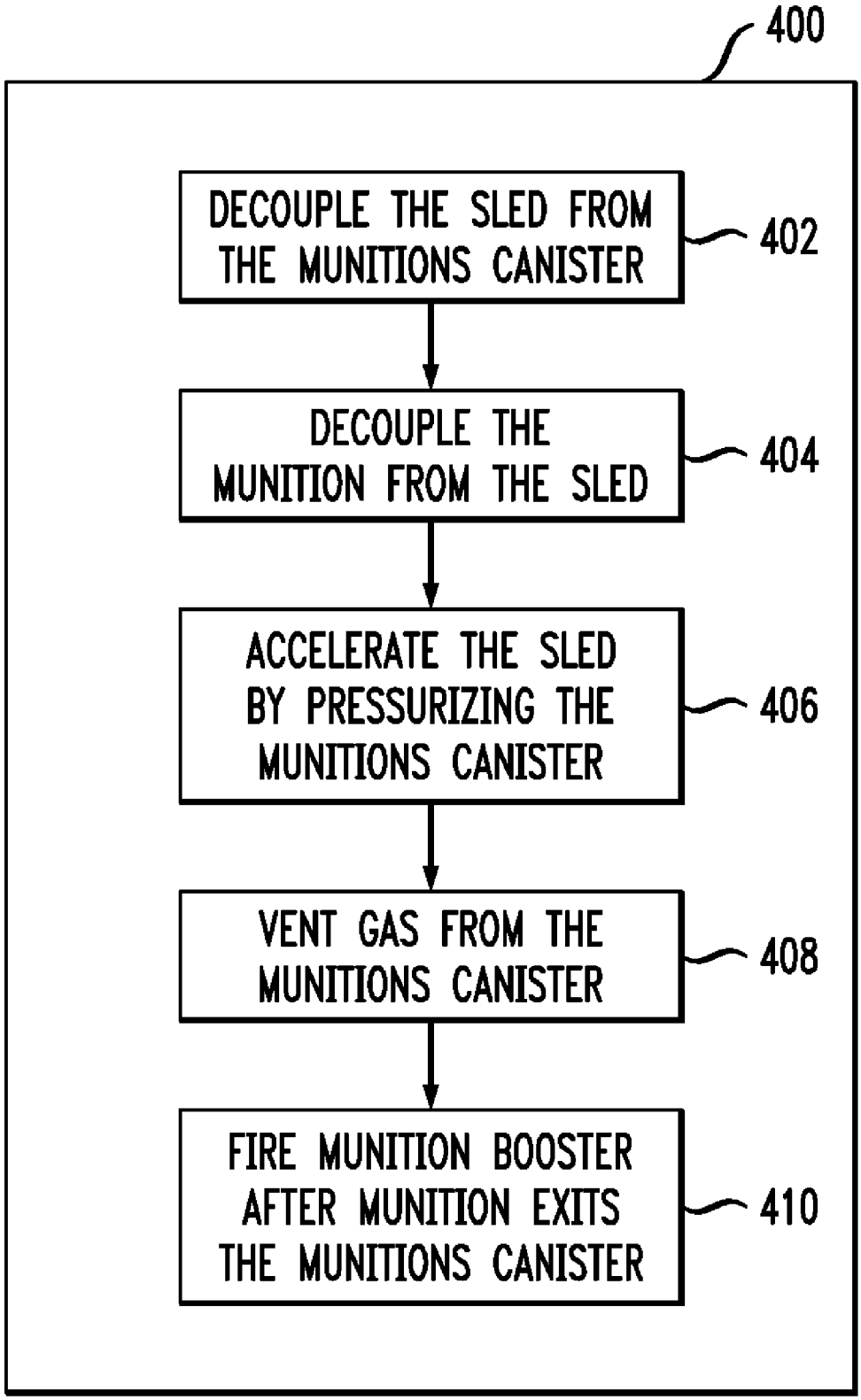
FIG. 4 depicts a flow diagram of a method in accordance with the illustrative embodiment of the present invention.

FIG. 4 depicts method 400 for launching a munition in accordance with the illustrative embodiment of the present invention.

Operations 402 and 404 recite releasing the sled from the canister and releasing the munition from the sled, respectively. These operations have been described previously, and can be implemented, for example, with active mechanisms (e.g., explosive bolts, etc.) or combined active/passive mechanisms.

Operation 406 recites accelerating the sled through the canister by pressurizing a region of the canister behind said sled. As previously described, pressurization can be performed by a captive gas generator, as in the illustrative embodiment, or by externally-sourced gas.

Operation 408 recites venting gas from the canister. In some embodiments, this is done "automatically" as the sled passes vents that are disposed near the forward end of the canister.

Operation 410 recites firing the booster on the munition after it exits the canister. This operation is performed when the munition has traveled at least about 150 feet away from the forward end of the canister. This is done using the munitions own inertia, as imparted by the energy in the pressurized gas.

It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Furthermore, it is to be understood that the above-described embodiments are merely illustrative of the present invention and that many variations of the above-described embodiments can be devised by those skilled in the art without departing from the scope of the invention. It is therefore intended that such variations be included within the scope of the following claims and their equivalents.

We claim:

1. A launch system, wherein the launch system is a cold-gas launch system for launching a munition without firing the munition's booster, the launch system comprising:

a canister for receiving said munition, said canister having an aft end and a forward end;

a sled for launching said munition, wherein said sled is disposed within said canister, and wherein said sled seals against an inside wall of said canister, and further wherein said sled is movable along the length of said canister;

an expandable plenum, wherein said plenum is a region of said canister between said aft end and said sled;

a source of gas, wherein said gas is introduced into said plenum to drive said sled toward the forward end of said canister;

a plurality of vents for venting said gas from said canister to an ambient environment, wherein said vents are disposed in said canister proximal to said forward end thereof; and a vent control mechanism, wherein said vent control mechanism is operable to open said vents when said sled moves along said canister and passes said vents.

2. The launch system of claim 1 further comprising said munition, wherein said munition is disposed on said sled.

3. The launch system of claim 1 wherein said source of gas is disposed aft of said sled in said aft end of said canister.

4. The launch system of claim 1 further comprising a munition-restraint system for reversibly securing said munition to said sled.

5. The launch system of claim 1 further comprising a sled-restraint system for reversibly securing said sled to said canister.

6. The launch system of claim 1 further comprising a closure for sealing said canister, wherein the closure is disposed on the forward end of the canister.

7. A launch system, wherein the launch system is a cold-gas launch system for launching a munition without firing the munition's booster, the launch system comprising:

said munition;

a canister for receiving said munition, wherein said canister has an aft end and a forward end;

a sled for launching said munition, wherein said sled is disposed within said canister, and wherein said sled seals against an inside wall of said canister, and further wherein said sled is movable along the length of said canister;

a gas generator, wherein said gas generator generates gas at a controlled rate and at a pressure suitable for propelling said sled toward said forward end of said canister with enough momentum to launch said munition and wherein said gas is supplied to a region between said sled and said aft end of said canister;

a plurality of vents for venting said gas from said canister to an ambient environment, wherein said vents are disposed in said canister proximal to said forward end thereof; and a vent control mechanism, wherein said vent control mechanism is operable to open said vents when said sled moves along said canister and passes said vents.

8. The cold-gas launch system of claim 7 wherein said gas generator is disposed aft of said sled in said aft end of said canister.

* * * * *